United States Patent [19]
Huang et al.
[11] 4,298,198
[45] Nov. 3, 1981

[54] ELECTRONIC GAME APPARATUS FOR A SINGLE PLAYER OR OPPOSING PLAYERS

[76] Inventors: Thomas L. Huang, 7024 Burnside Dr., San Jose, Calif. 95120; Ling Ling-Huang, 29 Scenic Dr., Poughkeepsie, N.Y. 12603

[21] Appl. No.: 32,383

[22] Filed: Apr. 23, 1979

[51] Int. Cl.[3] ..... A63F 9/00
[52] U.S. Cl. ..... 273/1 GC; 273/1 GE
[58] Field of Search ..... 273/1 E, 85 G, DIG. 28, 273/237, 1 GC, 1 GE, 86 R, 86 B

[56] References Cited

U.S. PATENT DOCUMENTS

| | | | |
|---|---|---|---|
| 3,874,669 | 4/1975 | Ariano et al. | 273/85 G |
| 3,902,723 | 9/1975 | Colling et al. | 273/1 GE X |
| 4,060,242 | 11/1977 | Huang et al. | 273/1 E |
| 4,095,785 | 6/1978 | Conner | 273/1 GC |
| 4,114,882 | 9/1978 | Mau | 273/85 G |
| 4,162,792 | 7/1979 | Chang et al. | 273/86 B X |

FOREIGN PATENT DOCUMENTS

| | | | |
|---|---|---|---|
| 1513858 | 6/1978 | United Kingdom | 273/85 G |

OTHER PUBLICATIONS

*Popular Electronics;* "Build the LED Target Game", Jun. 1977; pp. 50–52.
*Popular Electronics;* Jan. 1978; pp. 33–35, 40–43.

*Primary Examiner*—Anton O. Oechsle
*Attorney, Agent, or Firm*—Limbach, Limbach & Sutton

[57] ABSTRACT

A plurality of lights arranged in either a single column or plural columns is actuated by control circuits so that a single light at a time is first turned on and then off. This on-off action is done in succession between adjacent lights to give the appearance of a moving light or light streak. The game is operable in either of two modes, a single player mode and an opposing player mode. For opposing players, each one actuates his own control switch or switches to reverse the direction of apparent movement of lights and the object is to actuate the switches so as to reverse the direction in which the light appears to be moving before it reaches a predetermined position, e.g., an end light. If an end light is turned on, one player may score. A reset switch allows the game to continue. For a single player, the light streaks from one end towards the other end and then back and the player has to actuate a control switch before the light streaks completely back, in order to keep the light streak in motion. The speed of the streak can be varied.

32 Claims, 12 Drawing Figures

ELECTRONIC GAME APPARATUS FOR A SINGLE PLAYER OR OPPOSING PLAYERS

BACKGROUND OF INVENTION

1. Field of the Invention

This invention relates to an electronic game apparatus that can be played by a single player or by opposing players and, in particular, to a game apparatus in which a series of lights is successively lit to provide an object which the player or players seek to control.

2. Prior Art

Known in the prior art are various forms of electrical games in which one or more players interact through some form of switches with a light display, but to our knowledge, none of these prior art games is played with the same objectives, nor is any constructed and operated in the same manner, as our invention. U.S. Pat. No. 3,690,665-Becker discloses a game in which two rows of lights under the control of two sets of switches are under the control of opposing players. By actuating the switches, various combinations of lights are turned on and off and the object is to light all the lights in one of the rows, in order for a player to win or score. U.S. Pat. No. 3,376,041—Anderson discloses apparatus for playing the well known game of "Battleship" wherein a player first positions his ships on an array and each player then attempts to sink the other player's ships by guessing at their locations and "dropping bombs" or "firing shots" to indicated coordinate points of the array. This play is done in the apparatus disclosed in this patent by lights arranged in the form of the array and by control switches which light various ones of the lights as desired by the players.

While the above patents disclose games in which players actually interact with an object and oppose each other, there are other games such as illustrated in U.S. Pat. No. 3,637,212—Hurley, in which players compete serially or in parallel with each other to see who can obtain the highest score, there being no direct interaction or opposition between players. The game disclosed in this patent involves successively lighting a series of lights to simulate the flight path of a bird and a player attempts to "shoot down" the bird and thereby score a point.

Other types of games are for single players. One, for example, is disclosed in U.S. Pat. No. 3,770,269—Elder wherein a group of lights is randomly illuminated and the player attempts to stop the process so that one light is lit corresponding to a symbol preselected by the player. Another example is disclosed in U.S. Pat. No. 2,558,892—Burdick wherein three vertical rows of lights are used to simulate dropping a bomb on a ship. The object of the game is for the player to control the lighting so that three horizontally positioned lights at a time appear to move downwardly and drop the bomb on the ship.

There are also many games in which players interact, not with a light display, but with mechanical objects that move along a reversible path towards opposing goals. An example is disclosed in U.S. Pat. No. 3,295,348—Glass et al. A mechanical monster moves along a path under the control of two switches actuated by the players.

There are also known games that involve two players dealing each other with an object such as a tennis ball in a tennis game, a Ping Pong (trademark) ball in a table tennis game, or a lighted image on a television screen in games using television screen for display. However, this invention proposes the use of an array of lights, each light in the array being addressable digitally, as opposed to the analog presentation of data on a television screen.

SUMMARY OF THE INVENTION

An object of the invention is to provide a game in which a light appears to move at a high speed along a given path with the object of the game being for a player to reverse the direction in which the light appears to be moving before it reaches a predetermined position.

Another object is to provide a game that is exciting, visually stimulating, and requires mental concentration and fast physical responses.

A further object is to provide a game which can be played either by a single player or by opposing players.

Another object is to provide a game in which a light appears to streak along at a rapid rate and the rate can be varied to accommodate players with different skills and manual dexterity.

Still another object is to provide a game for two opposing players in which individual ones of a series of lights are turned on and then off in rapid succession to simulate a light moving back and forth at a high speed and each player has to reverse the direction in which the light appears to be moving before it reaches a light at the end of the series.

A further object is to provide a game in which a single player attempts to reverse the direction in which a light appears to be streaking at a rapid rate, before the light reaches a predetermined position.

Another object is to provide game apparatus with lights arranged in either a single column or an array of plural columns and rows, wherein a light may appear to move along different multiple paths through the array.

Other objects and advantages of the invention will be apparent from the following description taken in connection with the accompanying drawing wherein.

DETAILED DESCRIPTION

Figure 1:
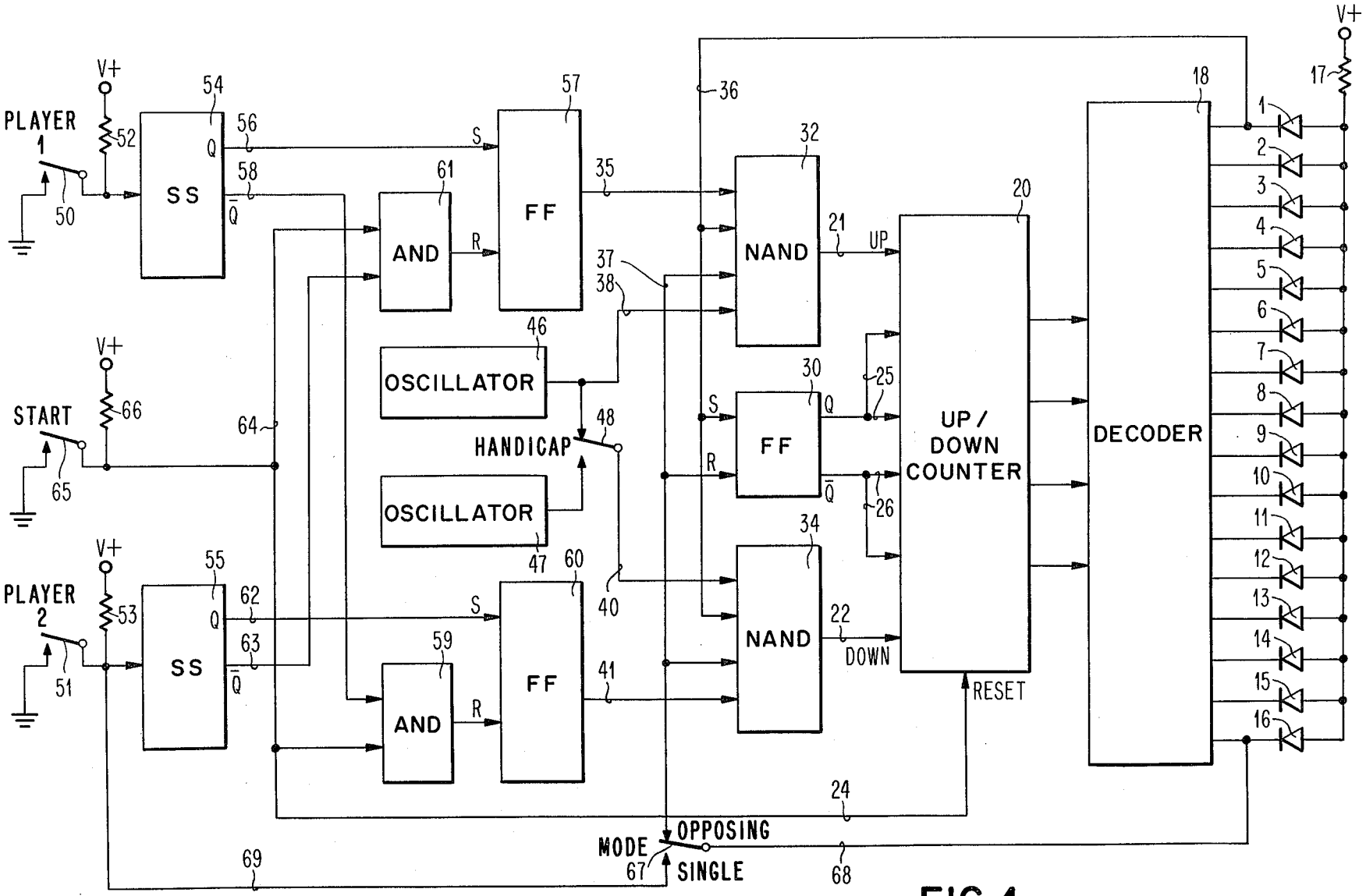
FIG. 1 is a circuit diagram of one embodiment of the invention.

Referring now to FIG. 1, the game apparatus of the invention includes a series of lights in the form of light emitting diodes (LED) 1–16 having their anodes connected in common to a voltage source V+ through a current limiting resistor 17. The cathodes of the LEDs are connected to the respective output lines of a decoder 18 which receives a four bit input and decodes or converts it to the corresponding one of sixteen possible outputs. When so converted, the output line is made active to apply a negative or down level potential to the attached LED thereby forward biasing it, causing current to flow and light to be emitted therefrom. The input lines of decoder 18 are connected to the output lines of an up/down counter 20.

Counter 20 has two inputs 21 and 22 for controlling the direction, up or down, in which the output thereof will proceed. When down input 22 is at an up level and a series of pulses are applied to the up input 21, counter 20 counts up the binary sequence 0000, 0001, . . . , 1110, 1111. When input 21 is at an up level and a series of pulses is applied to down input 22, the counter will count down so that the output signals will proceed down the binary sequence. The LEDs are arranged to correspond to the binary sequence whereby as the counter steps through the sequence, adjacent ones of the LEDs are progressively and successively lit. This progression of lighting one light at a time gives the appearance to a player of a moving light that travels along the series of lights in either of two directions. Counter 20 also has another input 24 which, when an active signal is applied to it, resets the counter 20 to a preset condition or number corresponding to a light other than end lights 1 and 16. The preset numbers are applied via binary number inputs 25 and 26 connected to the output of a flip flop (FF) 30. When FF 30 is set and input 24 is active, inputs 25 are active and cause light 4 to be lit to initiate the light streak at such light. When FF 30 is reset and input 24 is active, input 26 is active causing light 13 to be lit to start a streak. Obviously, other starting lights could be used.

For controlling the direction of counting and hence of movement of the streak, two four-input NAND circuits 32 and 34 have their outputs connected to inputs 21 and 22 respectively. The inputs to NAND 32 are connected to lines 35–38. When signals on lines 35–37 are active, i.e., at an up level, a series of pulses applied to line 38 causes NAND 32 to produce a series of pulses inverted relative to the input pulses which are used to step counter 20 in an up direction. Similarly, NAND 34 inputs are connected to lines 36, 37, 40 and 41 so that when lines 36, 37 and 41 are on active, pulses on line 40 produce pulses on the output 22 to step counter 20 down.

Two settable, variable frequency oscillators 46 and 47 provide the pulses for operating the counter. A single-pole, double-throw switch 48 has the pole thereof connected to line 40. When in the position shown in the drawing, oscillator 46 provides pulses to both NANDs 32 and 34 so that the light moves in both directions at the same speed. When the pole of switch 48 is placed in the other position, oscillator 47 is connected to line 40. The oscillators are settable by wheels 71 and 72 (FIG. 2) to different frequencies so that the light streak moves faster in one direction than in the other. Periods of 0.01 seconds to one second provides a range suitable for different players. When opposing players are using the game, the different speeds can be used to compensate for different speeds of player responses and, in effect, provides a handicap.

Two momentary contact switches 50 and 51 are connected between ground and a potential source V+ through resistors 52 and 53, the switches being also connected to the inputs of a single shot multivibrator (SS) circuits 54 and 55. These latter elements have oppositely phased outputs. When switch 50 is actuated, SS 54 provides a signal or pulse on line 56 that is connected to the SET input of a FF 57, the leading edge of the pulse being effective to set FF 57 and provide an active signal on line 35 to NAND 32. The other output 58 of SS 54 is connected to an AND gate 59 whose output is connected to the RESET input of a FF 60. Its output is in turn connected to input 41 of NAND 34. Thus, when switch 50 is actuated, FF 57 is set allowing a count up operation and FF 60 is reset to inhibit a count down operation.

Similarly, SS 55 is connected by line 62 to the SET input of FF 60 and by line 63 to one input of AND 61 whose output is connected to the RESET input of FF 57. When switch 51 is actuated in the opposing player mode of operation, FF 60 is set allowing counting down and FF 57 is reset to inhibit counting up.

A momentary contact switch 65 is connected through resistor 66 between potential V+ and ground. It is also connected by line 64 to the inputs of ANDs 59 and 61 and to the reset input 24 of counter 20. When switch 65 is actuated, FFs 57 and 60 are reset and counter 20 is set to the number determined by FF 30. Switch 65 acts as a START switch to set one of the predetermined lights 4 or 13 on.

A single-pole, double-throw switch 67 has its pole connected via line 68 to the cathode of diode 16. One contact is connected to line 37 and the other to line 69, the latter line being also connected to the input of SS 55. Switch 67 is a mode selector switch. When set as shown in the drawing, opposing players control operation of the game through switches 50 and 51 and when switch 67 is in the other position, a single player controls the game through only switch 50.

OPERATION

Start

The game includes a power switch 70 (FIG. 2) which when turned "on" allows potential from a source, such as a battery, to supply the potentials shown or implied in the drawing and activate the circuits. When the power is turned on, one of lights 1 or 16 will be lit, and it is necessary to actuate start switch 65. Prior to commencing play, switch 67 is set to the desired mode, and the oscillator frequency is set for the desired speed of play.

Opposing Players

Switch 65 is first actuated and this causes either one of the starting lights 4 or 13 to be lit depending on the state of FF 30. If light 4 is lit, switch 50 needs to be actuated to initiate the streak, and if light 13 is lit, switch 51 needs to be actuated to initiate the streak. Assuming light 4 is lit, when switch 50 is actuated, SS 54 sets FF 57 and resets FF 60. This causes a count up to occur which in turn causes lights in successively higher positions to be lit. That is, the light or light streak appears to move up or in one direction.

To keep the light streak in play, the other player needs to actuate switch 51 before light 16 is lit. Assuming the light streak is moving and has not yet reached the end light, when switch 51 is actuated, SS 55 sets FF 60 and resets FF 57 to cause or commence counting down. This reverses the direction in which the light appears to be streaking and then it is necessary for the other player to actuate switch 50 to keep the streak moving. This back and forth streaking will continue until one of the players fails to actuate the appropriate switch whereupon one of the end lights will be lit. When that occurs, a down level is applied via lines 36 or 68, depending on which end light was reached or lit, to both NANDS 32 and 34 to inhibit further counting. The action of an end light being lit allows one player to score a point in the event the players are playing for a score. Play can thereafter continue by actuating switch 65.

Single Player Mode

Switch 67 is first set to the single player mode wherein the cathode of light 16 is connected by lines 68 and 69 to SS 55. At the start, light 1 would be lit and it is necessary to actuate start switch 65 at which point light 4 would be lit. Then, the light streak is initiated by actuating switch 50. This causes the light to appear to move up to light 16, reverse direction and move towards light 1. In order to keep the light moving, the player needs to actuate switch 50 before light 1 is lit. If the switch is timely actuated, the light streak reverses direction. The light streak can be kept in motion until light 1 is lit whereupon, in the manner previously described, the light remains lit. Further play can continue by actuating switch 65 and repeating the process. The reversal action upon reaching light 16 occurs as follows: When light 16 is lit, the down level at the cathode actuates SS 55. This in turn sets FF 60 to initiate counting down and resets FF 57 to inhibit counting up.

When in the single player mode, the player can set switch 48 and oscillators 46 and 47 so that the light appears to move at different rates in the different directions. For instance, oscillator 46 may be set to a low frequency and oscillator 47 may be set to a very high frequency. The streak thus moves flow in one direction and upon reversal moves rapidly in the other direction towards light 1. The player would thus have to be alert and nimble in order to reverse the streak. The variable rate feature provides interest and challenge to a single player.

Figure 2:
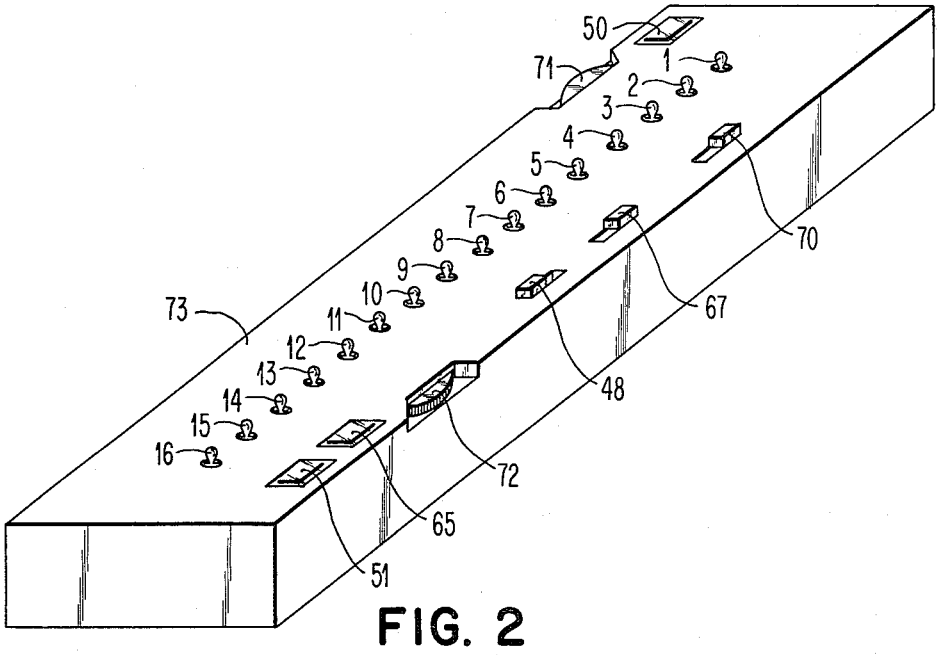
FIG. 2 is a perspective view of game apparatus embodying the invention shown in FIG. 1.

Referring now to FIG. 2, the invention can be packaged in a generally box shaped housing 73 that is of a size convenient to be held in the hand of a single player. Lights 1–16 are arranged in a straight line or linear series; however, it should be obvious that other arrangements can be used to provide a curved, arcuate or circular series. The various switches 48, 50, 51, 67 and 70 and wheels 71 and 72 are also mounted on housing 73 in exposed positions for activation by a player. Preferably, housing 73 is somewhat elongated and switches 51 and 50 are located at opposite ends for ease of access by opposing players.

Figure 3:
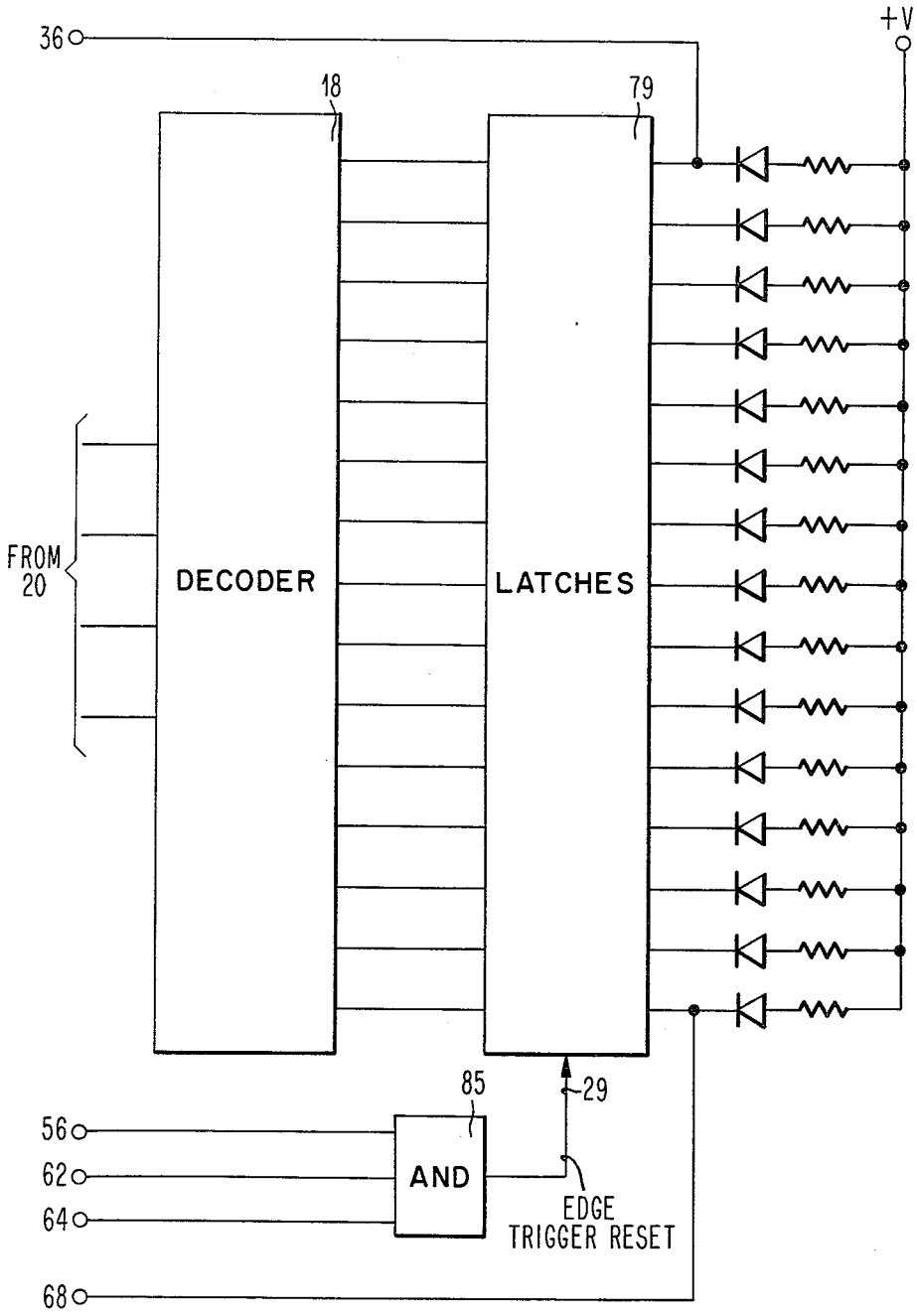
FIG. 3 is a circuit diagram of a modification of the embodiment of FIG. 1.

Growing Light Streak (FIG. 3)

The embodiment shown in FIGS. 1 and 2 may be modified to provide a game in which a light streak appears to grow in length. To accomplish this, a bank of resettable latches 79 may be inserted between decoder 18 and lights 1–16. The outputs of decoder 18 are individually connected to the set inputs of latches 79 whose outputs are normally at an up level. A down level output is achieved whenever a down level is applied to the set input. The lights remain on after the latches are set until reset by the leading edge of a down level signal on line 29 which may be produced by any individual or combination of 56, 62 and/or 64 being down. Lines 56, 62 and 64 are connected as inputs to AND 85 having output line 29. The incorporation of these latches provides the facilities to keep the lights on, effecting a lighting sequence that grows in length until it is reversed by the opponent at which the length is reset to zero and the sequence starts growing in the opposite direction. A game with this added feature can be also housed in the same package as that shown in FIG. 2.

Figure 4:
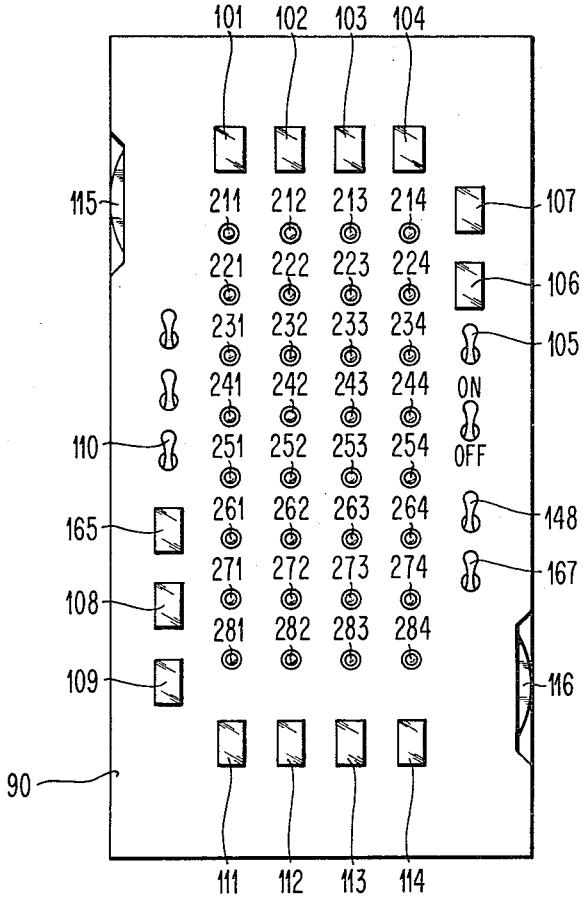
FIG. 4 is a top plan view of another embodiment of the invention in which the lights are arranged in an array.
Figure 5A:
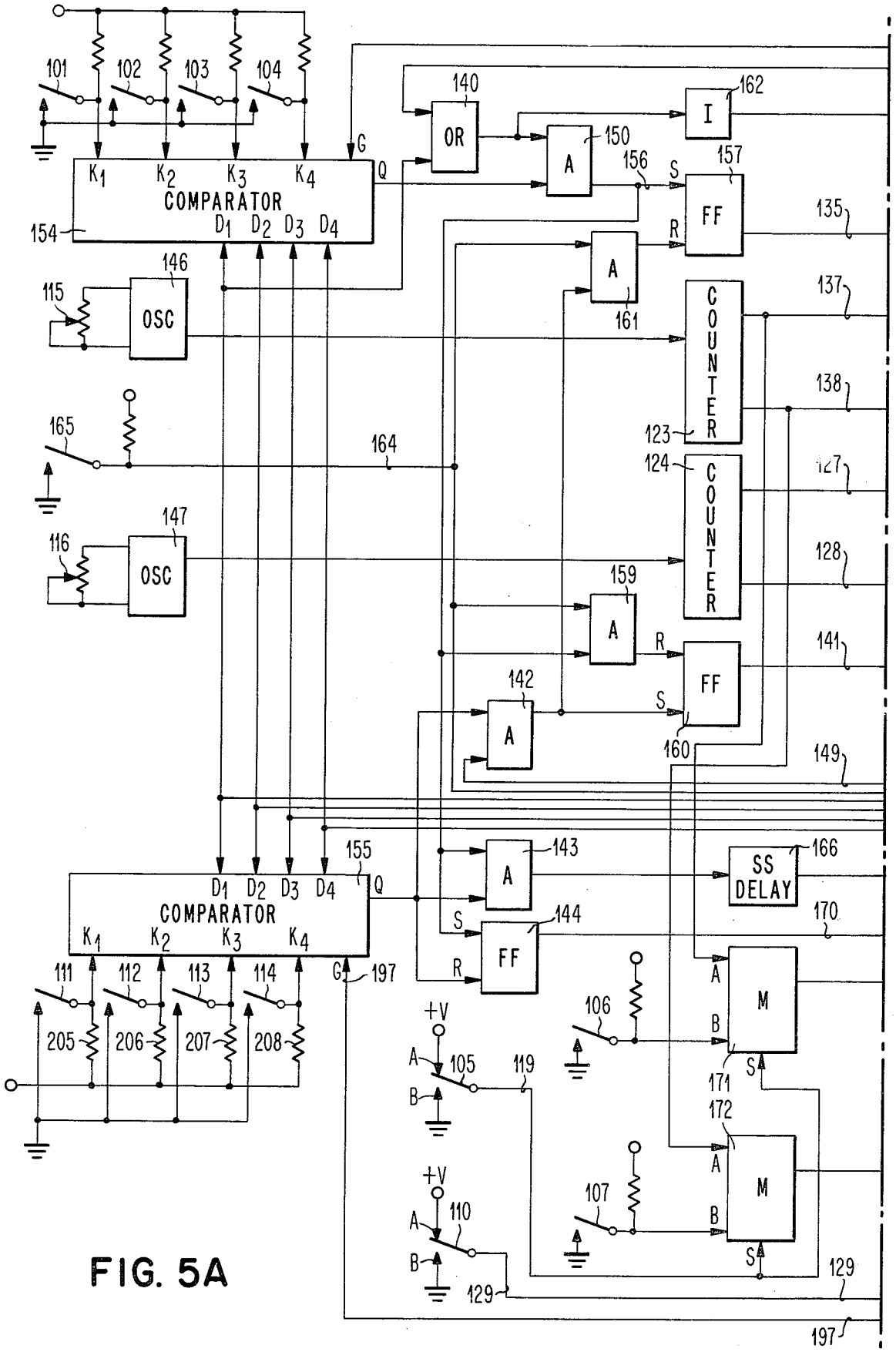
FIGS. 5A and 5B are a circuit diagrams of the embodiment of FIG. 4.
Figure 5B:
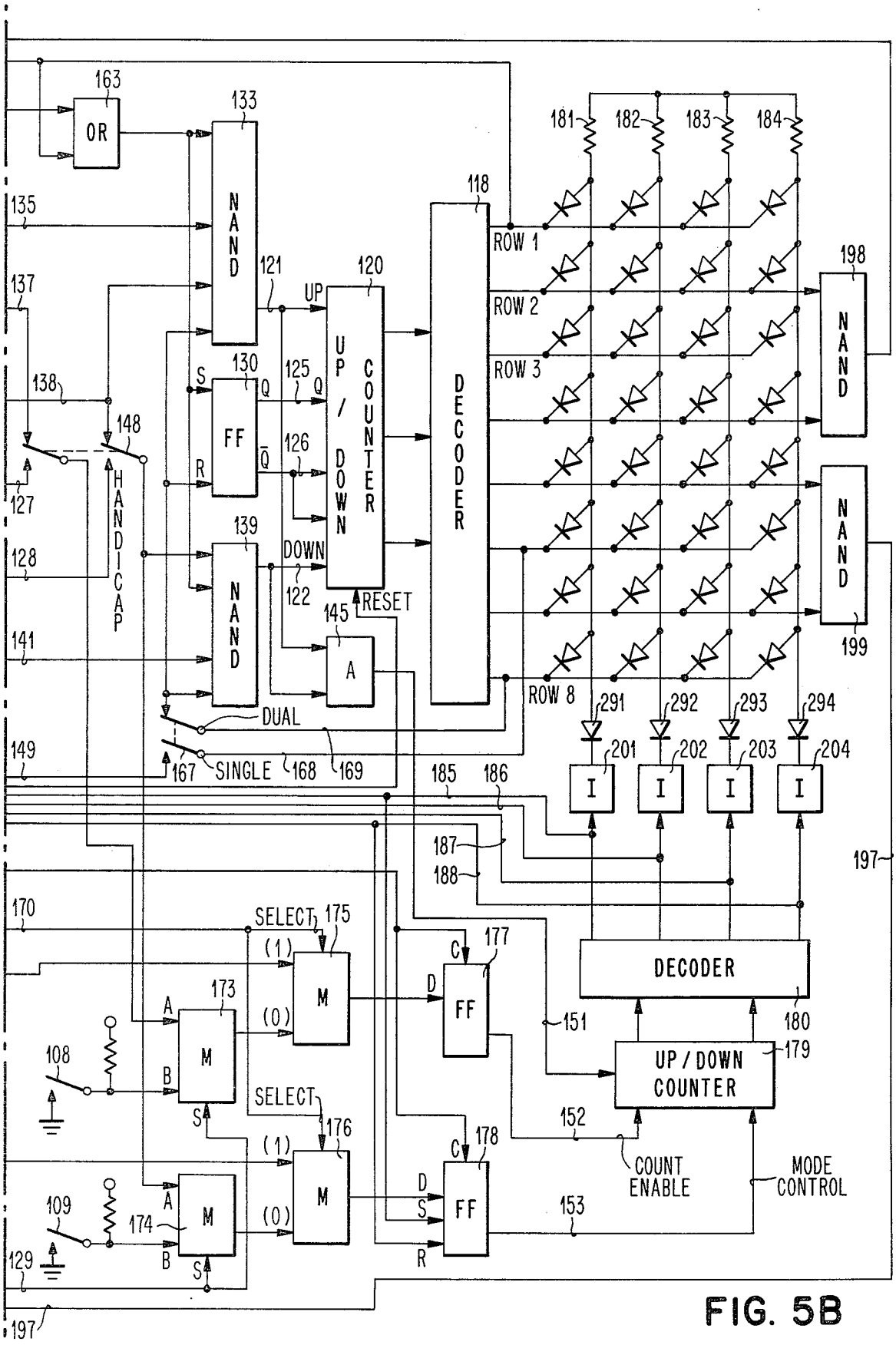
Figure 6:
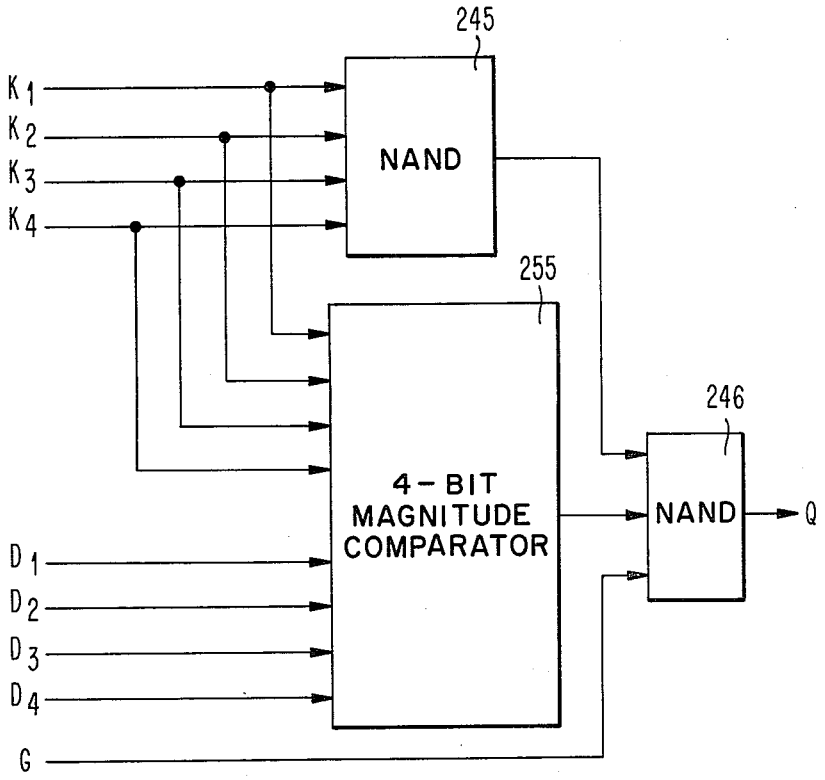
FIG. 6 is a circuit diagram of a detail.

Multiple Path Array (FIGS. 4–6)

The basic game apparatus described above can be expanded to include plural lines or series of lights arranged in an array of rows and columns and wherein a light appears to move between the end rows while moving from one row to the next either along the same column or in different columns. The number of lights in the array can be varied and one specific arrangement, shown by way of example, is a four-by-eight array, i.e., four columns of eight rows. Referring now to FIG. 4, the array of lights 211–214, 221–224, . . . , 281–284 is mounted on a housing 90 along with the various switches described in detail below, and with potentiometer 115 and 116 which control the speed of the "moving" light. Switches 101–104 are mounted at one end in alignment with the columns of lights for use by one player and switches 111–114 are similarly mounted at the other end for use by the other player. In operation, a light will appear to move towards one end and the player defending that end will have to actuate a column switch to intercept the light on such column in one of two defense rows. The interception will reverse the direction and cause the other player to assume a defense position. A score is made when there is no interception and the light reaches an end row.

Referring to FIG. 5, the operation of the array of lights is controlled by decoders 118 and 180 such that a particular light is lit when its corresponding row and column have been selected by decoder inputs from up/down counters 120 and 179 respectively. Decoder 118 controls the lighting movement in the column direction, i.e. from row to row, while decoder 180 controls the movement in the row direction, i.e. from column to column. As countup or count-down pulses are provided to counter 120 by either line 121 or line 122, depending on which player is playing, lighting streak will move from row to row. The control of movement in the row direction, from column to column, is determined by the inputs to "count-enable" and "mode control" of counter 179. The movement in the row direction is timed from the same pulse source as that in the column direction via the AND circuit 145 and line 151. However, line 152 connected to "count-enable" of counter 179 determines whether the streak or light apparently moves along a direct path or an oblique path. When line 152 is at an up level, counter 179 is disenabled. There will be no change in the row direction and the streak travels along a single column. However, when line 152 is at a down-level, counter 179 increments and/or decrements at the same pace as counter 120, the streak moves in an oblique manner between columns and rows. Decoders 118 and 180 have their un-selected out-puts normally at an up-level.

The array of lights may be made from any one of many varieties, such as incandescent, fluorescent, gas-discharge or light-emitting diodes, packaged in one single integrated enclosure or individually. Whenever one row is selected through decoder 118, all four lighting elements in that row are selected for lighting. The use of decoder 180 and inverters 201 through 204, connected to output lines thereof, together with the voltage clamping elements 291 through 294 allows only one light to be lit at a time. In the case illustrated, the array of lights are shown to be light-emitting diodes and voltage clamping elements are silicon or germanium diodes which will limit the voltage allowed on the anodes of the LED's when the cathodes of the clamping diodes are at a down-level. The only array light that is lit at a given moment is the one in the row and column selected by decoders 118 and 180 jointly. Resistors 181–184 limit the flow of current.

The generation and control of the row to row movement in the column direction is the same as that described for the single line game of FIG. 2, in which two players in turn set and reset flipflops 157 and 160 to allow pulses originated from variable frequency oscillators 146 and 147, via counters 123 and 124, to reach the up/down counter 120. Counter 123 and 124 are 2-bit binary counters which generate a count-of-2 and a count-of-4 signals on lines 137 and 138 for oscillator 146 and on lines 127 and 128 for oscillator 147. The combination of 137 and 138, or 127 and 128, is used to provide automatic determination of the direction of travel for a returned lighting streak. A double-pole double-throw switch 148 provides the option of handicap such that the speed of travel may be different for the two players. A double-pole double-throw switch 167 provides the mode choice of single or dual players. When switch 167 is at the "single" position connecting line 168 to line 149, the lighting streak is automatically returned when it reaches the 6th row containing lighting elements 261 through 264. This is possible because FF 160 may be set by the presence of a down level on line 149 via AND circuit 142.

Output lines 138 and 128 from counters 123 and 124 reduces the frequencies of oscillators 146 and 147 by a factor of 4. The combined use of outputs 137 and 138 from counter 123 and similarly 127 and 128 from 124 provides a sequence of four cyclic two-bit patterns (00, 01, 10, 11) within each pulse cycle on lines 137, 138 and 127 and 128 respectively. These two-bit patterns are dynamically applied to the A-inputs of four multiplexers 171, 172, 173 and 174. The B-inputs of 171 through 174 are connected to four momentary contact switches 106–109, 106 and 107 being controlled by one player and 108 and 109 being controlled by the other player. A toggle switch 105 is used by one player to choose whether the direction of the streak being returned to the other player is to be determined automatically by counter 123 or manually by momentary switches 106 and 107. Similarly, a toggle switch 110 allows the other player the same choice, that is, whether the direction of travel is to be determined automatically by counter 124 or manually through momentary switches 108 and 109.

The select-control of multiplexers 175 and 176 is provided by a flipflop 144 which is set or reset by the output from comparators 154 and 155 whenever a successful "compare" is effected through the actuation of one of the four momentary switches 101 through 104 by one player or 111 through 114 by the other. An output from comparator 154 will set flipflop 144 thereby allowing the outputs from multiplexers 171 and 172 to be applied to flipflops 177 and 178 through multiplexers 175 and 176. The output from AND 143, through a single shot delay circuit 166, clocks and latches the logic states as presented by 175 and 176 to 177 and 178 respectively. As a result, the "mode" and "count-enable" states of 179 are determined.

As shown in FIG. 6, the logic circuit used to implement the comparison function consists of the NAND circuits 245 and 246 and a 4-bit magnitude comparator 255 which produces an up-level output when the K inputs are equal to the D inputs. The use of NAND's 245 and 246 together with the gating input G effects a down-level output Q from NAND 246 only when one of the K inputs is down (because at any moment only one of the D inputs is down) and G is at an up-level. Since G is derived from either of the two NAND circuits 198 and 199 (FIG. 5), the "compare" function can only be effected when the streak reaches the "defense" row 4 or 2 for one player and the "defense" row 5 or 7 for the other player. A negative output at Q from either comparator 154 or 155 will cause a corresponding down-level output from AND circuits 150 or 142. A down-level output from AND 150 will cause FF 157 to set and FF 160 to reset, causing counter 120 to count up; similarly, a down-level output from AND 142 will cause FF 160 to set and FF 157 to reset, causing counter 120 to count down. The net effect of a successful "compare" is that the lighting streak is reversed toward the opposite direction.

Scoring by one player is accomplished when the lighting streak reaches the end row of the side of the other player. For the example illustrated, it is row 8, containing 281, 282, 283 and 284, for one player or row 1, containing 211, 213, 213 and 214, for the other player. Upon reaching the end row, the streak stops moving. The game may be reset to readiness by pressing momentary switch 165. This presents a down-level input to the preset control of up/down counter 120 allowing the output states on lines 125 and 126 of FF 130 to be preloaded into counter 120. When line 125 is up and 126 is down, one of the lights 221–224 in the second row will be lit. When line 125 is down and 126 is up, one of the lights 271–274 in the seventh row will be lit. The column position of the light depends on the contents in up/down counter 179. The next game will start from that light.

It is possible to limit the number of scoring lights to less than the total lights in the end row. To implement this feature, refer to one row in which 212, 213 and 214 are the scoring lights but the use of OR 140, AND 150, Inverter 162 and OR 163 brings about the effect that whenever the lighting streak reaches light 211, the streak is automatically reversed.

Figure 7:
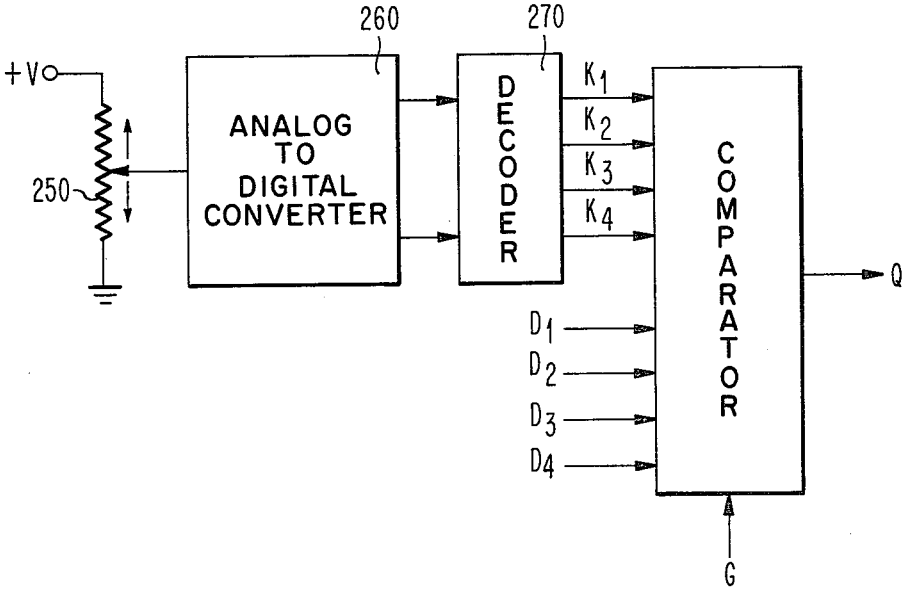
FIG. 7 is a circuit diagram of an alternate detail useful in the embodiment of FIGS. 4–6.

Furthermore, the function of the momentary switches, such as 111, 112, 113 and 114 together with the associated resistors 205 through 208, may be performed through the use of an analog method such as the use of a potentiometer 250 together with an analog-to-digital converter 260 and a decoder 270 as shown in FIG. 7. Depending on the position of the tap on potentiometer 250, the analog voltage is converted to a binary representation which is then decoded into individual lines as inputs to K1, K2, K3 and K4. This method may also be applied to games that have a great deal more columns than the four used in this discussion. For a 16 column game, e.g., a four-bit analog-to-digital converter may be used and a four-bit-to-16-line decode suffices.

Multiple Paths in an Array of Light with Illuminated Defense Lights

In FIG. 4, a circuit was shown in which the players' defense was restricted to the 2nd and 4th rows for one player and 5th and 7th rows for the other player. The column position of the defense light was determined and controlled by the use of four contact switches corresponding to the four columns, or by the use of analog-to-digital converters (ADC) as shown in FIG. 7.

Figure 8A:
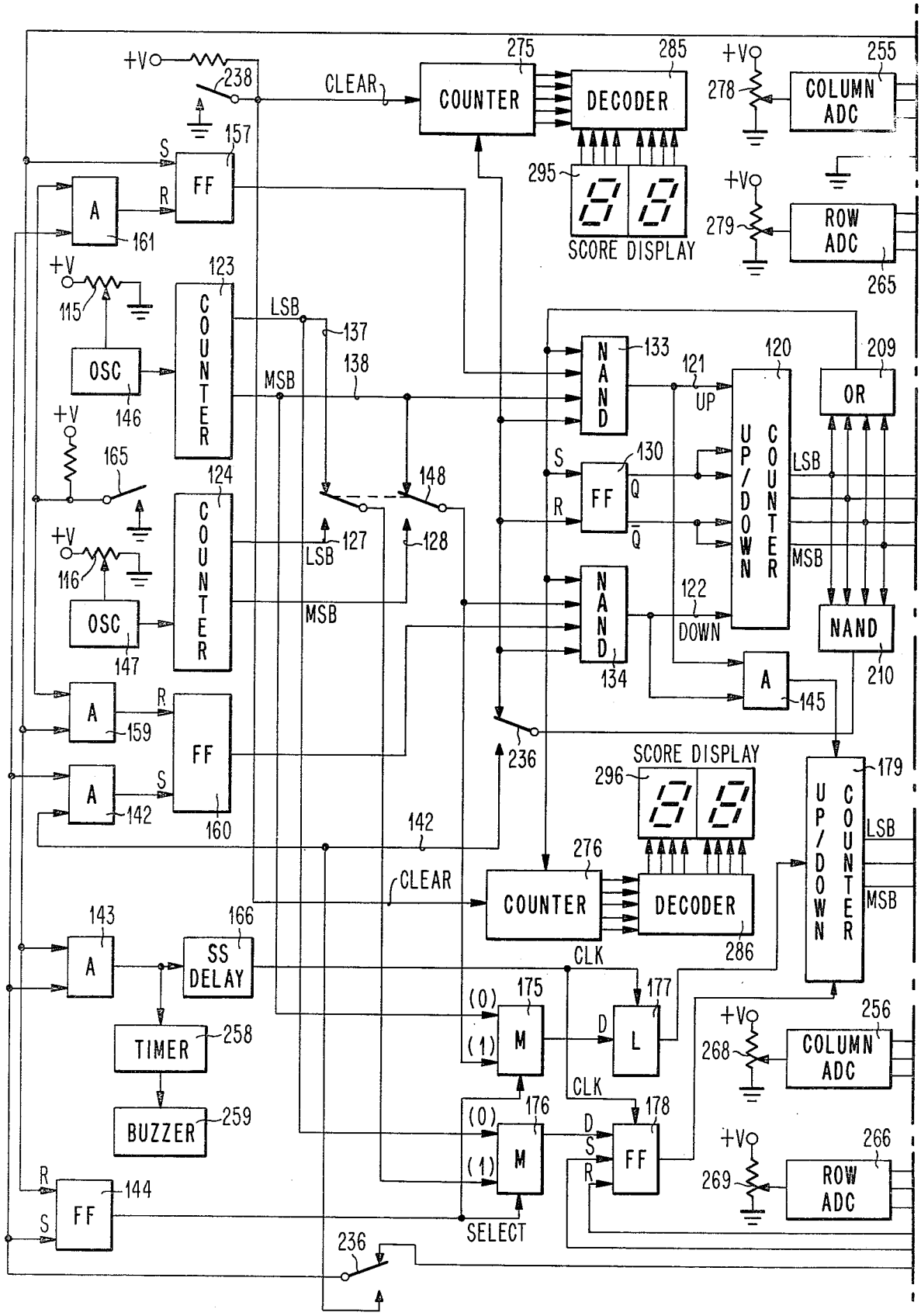
FIG. 8 is a circuit diagram of another embodiment of the invention.
Figure 8B:
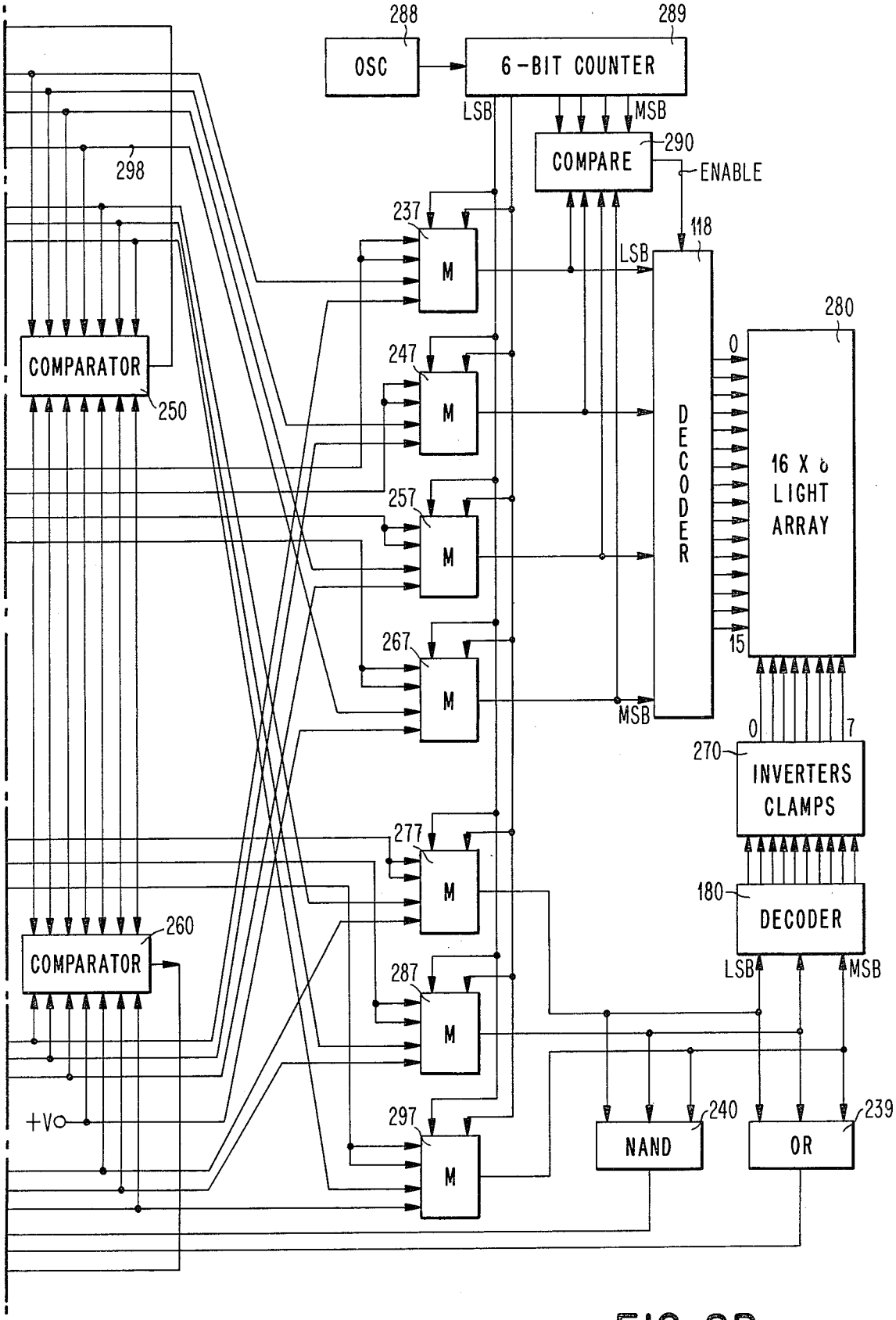

In FIG. 8, another circuit is shown in which each player's defense lights as well as the streaking light is illuminated. The control logic associated with the column and row up/down counters 120 and 179 is same as that shown in FIG. 5. However, a display driver circuit together with a multiplexing method achieves the effect of simultaneous illumination of the streaking light and the players' defense lights.

Refer now to FIG. 8, a light array, 280, of sixteen rows and eight columns is used for illustration. It is electrically connected in the same manner as the array shown in FIG. 5. Array 280 is selected and activated jointly by decoders 118 and 180 together with the inverters and clamping circuits 270 similar to those used in FIG. 5. A high frequency oscillator, 288, preferrably more than 50 times faster than the pulse rate applied to counters 120 and 179 via lines 121 and 122, actuates a counter 289. The position of the streaking light is determined by the four-bit output from counter 120 and the three-bit output from counter 179. The seven outputs are respectively applied to the inputs of multiplexers 237, 247, 257, 267, 277, 287 and 297. The position of the defense light for one player is restricted to the upper eight rows in the light array 280, and is determined by the three-bit outputs from column analog-to-digital converter (ADC) 255, ground line 298, and the three-bit output from row ADC 265. These seven lines are also respectively connected to the seven multiplexers 237, 247, 257, 267, 277, 287 and 297. Similarly, the defense light for the other player is restricted to the lower half of the light array, and is determined by the three-bit outputs from column ADC 256, the V+ line 299, and the row ADC 266. These lines are similarly connected to the inputs of multiplexers 237, 247, 257, 267, 277, 287 and 297 respectively.

The output from oscillator 288 is applied to the input of six-bit binary counter 289. The two least significant bits of its output are applied to the multiplexers and are used to select, in a cyclic manner, the identities of the streaking light and the players' defense lights as presented to the inputs of the seven multiplexers. The connections are such that the identity (position) of the streaking light is passed to decoders 118 and 180 when the multiplexers select combinations are 00 and 01, the position of the defense light in the upper half selected when the select combination is 10, and the position of the defense light in the lower half is selected when the select combination is 11.

The four output lines from M 237, 247, 257 and 267 are also connected to the input of comparator 290. At the same time, the four most significant bits from display driver counter 289 are applied to the other inputs to comparator 290. The comparator 290 produces a pulse whenever the two four-bit inputs are equal. This "compare-equal" pulse is used to enable decoder 118 such that during every cycle of 16 counts for the four most significant bits from counter 289, the streaking light as well as the defense lights for the players are illuminated for a short duration respectively. Since the oscillator 288 runs at a very high frequency, the repeated illumination of short durations of the selected lights, one at a time, presents the appearance of simultaneous lighting of the streaking light as well as the defense lights.

The detection of when a border column has been reached is accomplished with NAND 240 and OR 239, which in turn control the counting mode of counter 179 through flipflop 178. The detection of when the lighting streak reaches either of the end rows is provided by OR 209 and NAND 210 at the outputs of counter 120. The option of single player and opposing players modes is provided by the double-pole double-throw toggle switches 236's similar to toggle switch 67 and 167, described above.

Automatic score keeping is provided for one player by the combination of a counter 275, a decoder 285 and a digital display 295 and for the other player by a counter 276, a decoder 286 and a digital display 296. A momentary switch 238 is used to clear both counters 275 and 276. When the moving light reaches an end row, the associated counter is incremented and the score is automatically displayed.

A single shot timer 258 and a buzzer 259 are used to produce a short buzz each time a player succeeds in reversing the direction of the light streak.

Figure 9:
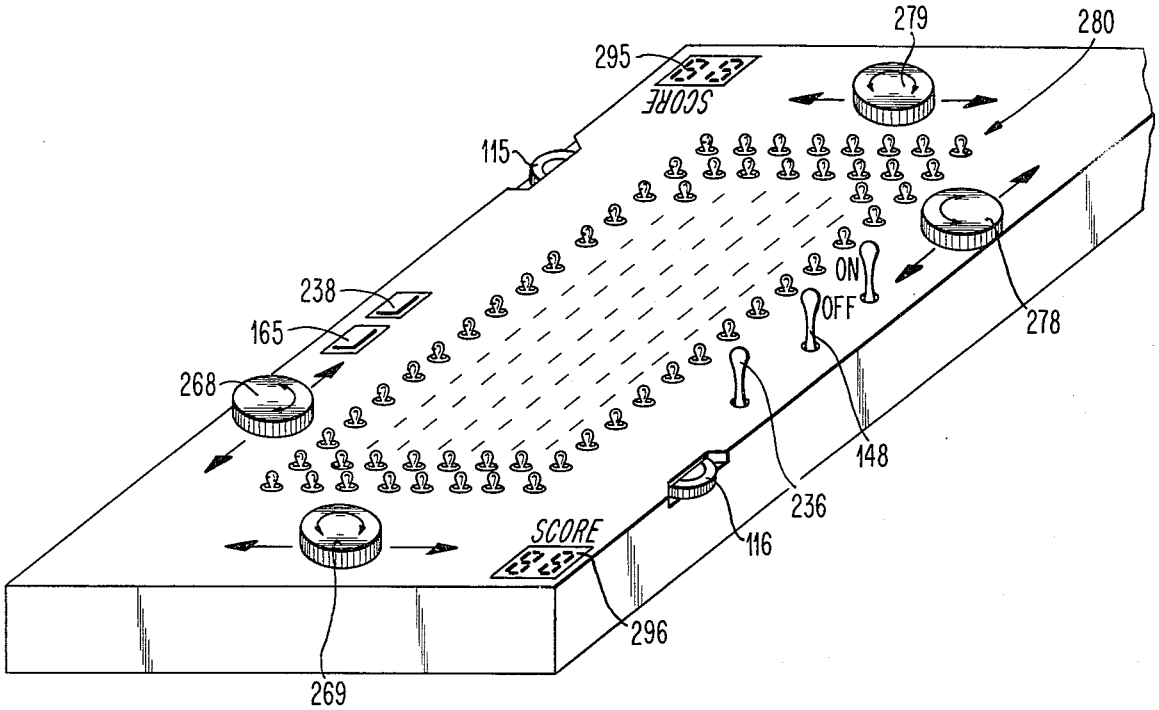
FIG. 9 is a perspective view of game apparatus embodying the embodiment of FIG. 8; and, FIG. 10 is a circuit diagram of an alternate detail useful in the embodiment of FIGS. 8 and 9.

FIG. 9 shows how the components of FIG. 8 are packaged into a game apparatus. It should be pointed out here that the rotary potentiometers 268, 269, 278 and 279 may be replaced with equivalent linear slide type or they may be removed from the box and connected to the set by way of plugs and wires. These potentiometers are located at opposite ends for ease of access and operation by the players.

Figure 10:
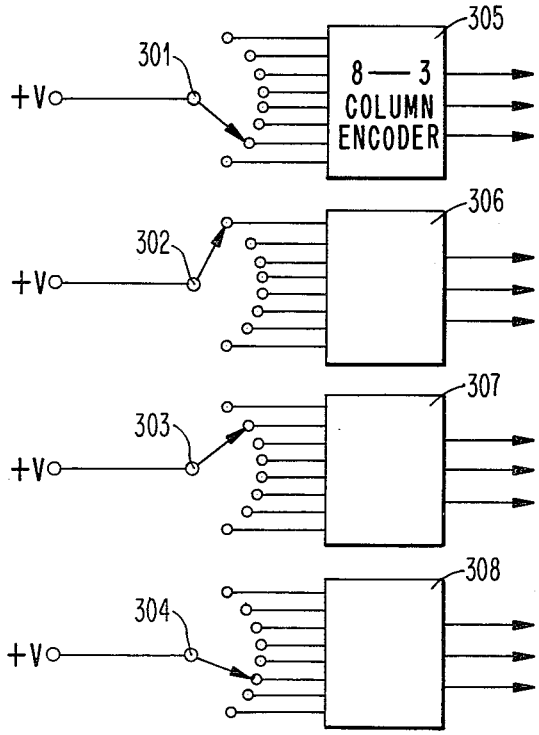

FIG. 10 shows the schematic diagram of the same 16 ×8 array game in which ADC's 255, 265, 256 and 266 controlled by the players have been replaced by rotary contact switches 301, 302 for one player and 303 and 304 for the other player. The players would operate the switches to achieve results the same as those achieved using the potentiometer controlled ADC's.

It should be apparent to those skilled in the art that many changes and omissions can be made in the details and arrangements of parts without departing from the scope of the invention as defined in the appended claims.

What is claimed is:

1. In a game apparatus, the combination comprising:

a plurality of selectively energizable light sources disposed for view by opposing players;

circuit means for controlling the energization of said light sources and having four states of operation, said circuit means being operative in first and second states to energize predetermined ones of said series of light sources to effect the appearance to the players of stationary lights, said circuit means being operative in third and fourth states to progressively energize said light sources in different directions between adjacent lights to effect the appearance to the players of a moving light;

means responsive to one of said predetermined light sources being energized to switch said circuit means into one of said first and second states;

and first and second player-actuated switches each adapted to be controlled by different players to switch said circuit means between said third and fourth states so long as none of said predetermined light sources is energized, whereby each player may attempt to reverse the direction of the progression of energization of said light sources before such progression energizes a predetermined light source.

2. The combination of claim 1 comprising:

adjustable oscillator means operative to control the rate at which said light sources are progressively energized, said oscillator being adjustable to allow a player to vary the rate at which said moving light appears to move.

3. The combination of claim 2 wherein:

said oscillator means comprises first and second oscillators adjustable to allow the rate of said moving light to be different for different directions of apparent movement thereof.

4. The combination of claim 3 comprising:

switch means connected to said oscillators being actuatable between two states, said switch means being operative in one state to connect only one of said oscillators whereby the rate of movement is the same in both directions, and said switch means is operative in the other state to connect both oscillators whereby the rate of movement differs in each direction.

5. The combination of claim 1 comprising:

a mode switch settable in either of two different conditions to allow the game to be played by either a single player or by opposing players;

and means operable when said mode switch is in the single player mode to automatically switch from said second state, wherein one of said predetermined light sources is energized, to said fourth state, to effect the appearance to the player of a reversible moving light under the control of only one of said player-actuated switches.

6. The combination of claim 5 comprising:

timing means operative to control the rate at which said moving light appears to move and including means effecting different rates of such movement in different directions.

7. The combination of claim 1 comprising:

selectively actuated start means adapted to be actuated by a player, when one of said predetermined light sources is energized, to energize a preselected other one of said light sources;

and means responsive to actuation of one of said player-actuated switches to place said circuit means in one of said third and fourth states to initiate progressive energization beginning with said preselected other one.

8. In an electro-optical game apparatus, the combination comprising:

a plurality of selectively energizable light sources arranged in a series including two spaced end light sources and a plurality of other light sources therebetween and adapted to be viewed by opposing players;

a binary counter providing a series of different binary output signals each of which corresponds to a different one of said lights is used to control energization thereof, said counter being selectively operable to count up and down a binary sequence at a rate determined by timing signals;

first means connected to said counter and said light sources to energize the one of said sources corresponding to output signals from said counter;

second means supplying said timing signals;

logic means for selectively controlling the application of said timing signals to said counter, said logic means being operative to apply said timing signals and to inhibit the application of such signals to said counter;

first and second control switches each adapted to be controlled and operated by one of the opposing players;

first circuit means responsive to actuation of said control switches for operating said logic means and said counter to cause said counter to reverse the direction of counting so long as both end light sources in said series are de-energized;

and second circuit means connected to said end light sources and said logic means and being operative to inhibit said timing signals in response to energization of either one of said end light sources.

9. The combination of claim 8 wherein:

said second means comprises an adjustable, variable-frequency oscillator adapted to be adjusted by a player for varying the rate at which said light sources are energized.

10. The combination of claim 8 comprising:

third means defining a count corresponding to a predetermined light source other than one of said light sources;

third circuit means including selectively actuated start switch means adapted to be actuated by a player when one of said end lights is energized, for setting said counter to said count in said third means so as to energize said predetermined light source.

11. The combination of claim 10 comprising;

means responsive to actuation of one of said control switches, when said predetermined light source is energized, to actuate said logic means and thereby actuate said counter to begin counting from such count.

12. The combination of claim 8 wherein:

said counter provides an N-bit signal having less bits than the number M of light sources;

and said first means includes an N-to-M decoder having M output lines connected respectively to said light sources.

13. The combination of claim 8 wherein:

said light sources are located at spaced points along a straight line.

14. The combination of claim 13 comprising:

a plurality of additional series of light sources arranged parallel to each other and to said first mentioned series, and third circuit means connected to said first and second circuit means and to said additional series, said third circuit means being operative to progressively energize adjacent ones of said light sources to effect the appearance of a light moving between and along said series.

15. The combination of claim 14 wherein:

said third circuit means includes a second binary counter for controlling in which series a light source is energized; and, said first-mentioned binary counter is operatively connected to control which light source along a series is energized at any given time.

16. In electronic game apparatus, the combination of:

a light array comprising a plurality of selectively energizable discrete light sources arranged in a plurality of rows and columns for view by two opposing players, said light sources including a first scoring light source and a second scoring light source spaced from said first scoring light source;

selectively actuated first and second devices under the respective control of said opposing players;

and circuit means comprising first means connected to said light sources and operative to selectively energize successive ones of said light sources one-at-a-time to effect the appearance of a moving light traveling in a direction towards said first scoring light source, second means operative in response to actuation of said first device to reverse the direction of travel of said moving light causing it to travel towards said second scoring light source, such reversal being done by energizing successive one of said light sources one-at-a-time, third means operative in response to actuation of said second device to reverse the direction of travel of said moving light causing it to travel towards said first scoring light, and fourth means responsive to energization of either of said scoring light sources to inhibit further energization of any other light source, whereby said players can operate said apparatus by alternately actuating said first and second devices as said moving light appears to move alternately towards said scoring light sources, until such time as when one of said scoring light sources is energized.

17. The combination of claim 16 wherein:

said light sources are identified by digital addresses as to row and column, and said circuit means comprises addressing means to generate digital addresses one-at-a-time for selecting the light source to be energized.

18. The combination of claim 17 wherein:

said addressing means comprises first and second binary up/down counters for generating the row address and the column address respectively of an energized light source, timing means connected to said counters for supplying timing pulses thereto to increment and decrement said counters at a predetermined rate to thereby control the apparent speed of the moving light.

19. The combination of claim 18 wherein:

said timing means comprises first and second oscillators supplying said timing pulses at different frequencies, and selectively actuated first switch means operable where in one position control to supplying timing pulses from only one of said oscillators whereby the speed of the moving light is constant, said first switch means being operable when in another position to control supplying said timing pulses whereby the speed of the moving light differs dependent upon which of said scoring light sources it is moving towards.

20. The combination of claim 19 wherein:

each of said oscillators is variable as to the frequency of timing pulses produced thereby, and said combination further comprises player actuated adjustment devices for varying said oscillators, to thereby allow the players to control the speed of the moving light.

21. The combination of claim 16 further comprising:

selectively actuated means operative when one of said scoring light sources if energized to de-energize such source and initiate movement of the moving light in a direction towards the other of said scoring light sources.

22. The combination of claim 21 comprising:

scoring display devices associated with said players for keeping scores, and means responsive to energization of said scoring light devices to register a score on said display devices.

23. The combination of claim 21 wherein:

the direction of movement can be along any one of several different paths, and said combination further comprises path control means for controlling which path the moving light will traverse.

24. The combination of claim 23 wherein:

said path control means comprises player actuated control devices, and means responsive to actuation of such devices for controlling the path along which the moving light will traverse.

25. The combination of claim 23 wherein:

said path control means includes means for automatically defining the path along which the moving light will traverse.

26. The combination of claim 16 wherein:

at least one predetermined one of said light sources form a first defensive light source for one player, at least one other predetermined one of said light sources forms a second defensive light source for the other player, and said second means and said third means are respectively operative to reverse the direction of travel of the moving light only when such light is coincident with one of said defensive light sources.

27. The combination of claim 26 comprising:

player controlled means for varying which one of said light sources is a defensive light source, and said circuit means includes multiplexing means for alternately energizing said defensive light sources with the moving light at a rapid rate giving the appearance of such lights being concurrently energized, whereby a player can visually observe the relative positions of the moving light and a defensive light source and attempt to move such defensive light source so as to intercept the moving light.

28. The combination of claim 16 wherein said first and second scoring light sources are located in end rows of said array, there being at least one non-scoring light source in each end row, and said circuit means further comprises means to automatically reverse the direction of the moving light upon energization of one of said non-scoring light sources.

29. The combination of claim 16 wherein:

said array includes additional scoring light sources, there being a number of scoring light sources associated with one player different than the number of scoring light sources associated with the other player.

30. The combination of claim 16 comprising:

an audio device, and means responsive to operation of said second and third means to actuate said audio device to emit an audible sound each time the moving light is reversed in its direction of travel.

31. The combination of claim 27 wherein said player controlled means comprises:

a player actuated potentiometer providing an analog signal, and analog-to-digital conversion means for converting said analog signal to digital signals controlling the position of said defensive light source.

32. The combination of claim 26 wherein:

said first and second defensive light sources are located in different predetermined rows of said array, and said second and third means comprises player actuated momentary contact switches that selectively enable said defensive light sources so that the moving light is reversed only when one of said contact switches is closed.

* * * * *

UNITED STATES PATENT OFFICE

CERTIFICATE OF CORRECTION

Patent No. 4,298,198 Dated December 2, 1981

Inventor(s) Thomas L. Huang, et al.

It is certified that error appears in the above-identified patent and that said Letters Patent are hereby corrected as shown below:

| | |
|---|---|
| Column 5, line 34 | "flow" should be --slow--. |
| Column 8, line 26 | "211, 213, 213 and 214" should be --211, 212, 213 and 214--. |

Signed and Sealed this

*Second* Day of *February 1982*

[SEAL]

*Attest:*

GERALD J. MOSSINGHOFF

*Attesting Officer*

*Commissioner of Patents and Trademarks*